US008747218B2

(12) United States Patent
Ellis

(10) Patent No.: US 8,747,218 B2
(45) Date of Patent: Jun. 10, 2014

(54) GAMING APPARATUS AND SYSTEMS WITH A TRIGGERABLE FEATURE EVENT

(75) Inventor: Benjamin James Ellis, Wentworthville (AU)

(73) Assignee: Dynamite Services Pty Limited, New South Wales (AU)

( * ) Notice: Subject to any disclaimer, the term of this patent is extended or adjusted under 35 U.S.C. 154(b) by 65 days.

(21) Appl. No.: 13/416,779

(22) Filed: Mar. 9, 2012

(65) Prior Publication Data

US 2012/0220367 A1 Aug. 30, 2012

Related U.S. Application Data

(63) Continuation-in-part of application No. 12/893,095, filed on Sep. 29, 2010.

(30) Foreign Application Priority Data

Sep. 30, 2009 (AU) ..... 2009222486
Mar. 9, 2011 (AU) ..... 2011201126

(51) Int. Cl.
*A63F 9/24* (2006.01)

(52) U.S. Cl.
USPC ..... 463/25; 463/16; 463/20

(58) Field of Classification Search
USPC ..... 463/16, 20, 25, 27, 36, 42
See application file for complete search history.

(56) References Cited

U.S. PATENT DOCUMENTS 6,234,897 B1 * 5/2001 Frohm et al. ..... 463/20
6,270,409 B1 * 8/2001 Shuster ..... 463/20
6,860,811 B1 * 3/2005 Wilkins ..... 463/25
2003/0069056 A1 * 4/2003 Cormack et al. ..... 463/16
2003/0216170 A1 * 11/2003 Walker et al. ..... 463/25
2004/0072613 A1 * 4/2004 Visocnik ..... 463/25
2005/0043092 A1 * 2/2005 Gauselmann ..... 463/36
2005/0215311 A1 9/2005 Hornik et al.
2006/0035705 A1 * 2/2006 Jordan et al. ..... 463/25
2006/0073874 A1 * 4/2006 Cregan et al. ..... 463/20
2006/0073887 A1 4/2006 Nguyen et al.
2007/0060241 A1 3/2007 Low et al.
2008/0026816 A1 * 1/2008 Sammon et al. ..... 463/20
2008/0139296 A1 6/2008 Baerlocher et al.
2009/0011826 A1 * 1/2009 Acres ..... 463/27
2009/0075728 A1 * 3/2009 Acres ..... 463/25
2009/0111561 A1 4/2009 Dewaal et al.

(Continued)

FOREIGN PATENT DOCUMENTS

AU 2003236456 3/2004
WO WO-2005/037387 4/2005
WO WO-2009/062156 5/2009

*Primary Examiner* — Dmitry Suhol
*Assistant Examiner* — Jason Yen
(74) *Attorney, Agent, or Firm* — Venable LLP; Henry J. Daley

(57) ABSTRACT

An embodiment of the present invention provides a bonus scheme associated with a feature event, or part thereof, which provides a plurality of feature games. With reference to the embodiment illustrated in FIG. 4, a first feature event is conducted at Steps S3 to S5, the outcome of which determines a feature event win value. At Step S7 the feature event win value is compared to a threshold value and, if the gaming process win value is less than, or equal to the threshold value, the player becomes eligible to trigger a second feature event at Step S9.

33 Claims, 5 Drawing Sheets

(56) References Cited

U.S. PATENT DOCUMENTS

2009/0124391 A1* 5/2009 Nelson et al. ..... 463/42
2009/0247267 A1* 10/2009 Acres ..... 463/20
2010/0087243 A1* 4/2010 Saito et al. ..... 463/20
2010/0093416 A1* 4/2010 Seelig et al. ..... 463/16

* cited by examiner

GAMING APPARATUS AND SYSTEMS WITH A TRIGGERABLE FEATURE EVENT

The present application is a Continuation-In-Part of U.S. patent application Ser. No. 12/893,095, dated 29 Sep. 2010; and claims priority there from, the entire contents of which is incorporated herein by reference. The present application also claims priority from Australian Patent Application No. 2009222486, dated 30 Sep. 2009 and Australian Patent Application No. 2011201126, dated 9 Mar. 2011, the entire contents of which is incorporated herein by reference.

FIELD OF THE INVENTION

The present invention relates to gaming apparatus and systems. It relates for example to electronic gaming machines and to networked gaming systems, such as Internet-based gaming systems.

BACKGROUND OF THE INVENTION

Gaming machines have been a popular form of entertainment for many years. This popularity has been enhanced with the advent of electronic gaming machines and computer-based gaming systems, such as are provided over the Internet.

Many different types of game are playable. They include for example standard slot-machine type games with spinning reels, poker machines, keno, bingo, blackjack, roulette, pachinko and the like.

A user will typically place a bet, press a button or pull a lever to begin a game, and will win or lose based upon the gaming machine's play algorithm and random number generator.

An aim of the present invention is to provide gaming apparatus having novel features for enhancing gameplay interest.

SUMMARY OF THE INVENTION

According to a first aspect of the invention there is provided a gaming method for use with a gaming apparatus configured to provide a first feature event having a prize award potential, the method including the steps of:

defining a threshold value;

conducting the first feature event, or part thereof, so as to determine a feature event win value; and comparing the feature event win value to the threshold value and, if the feature event win value is less than or equal to the threshold value, providing a triggerable second feature event, whereby the second feature event has a prize award potential that is greater than the prize award potential of the first feature event.

Preferably the first feature event includes the provision of a plurality of feature games and the second feature event includes the provision of a plurality of feature games. In one embodiment a number of feature games provided by the second feature event exceeds a number of feature games provided by the first feature event. Preferably the number of feature games provided by the second feature event is calculated in accordance with a predetermined or random calculation scheme. The calculation scheme may provide a substantially inverse relationship between the number of feature games provided by the second feature event and the feature event win value.

In one embodiment a multiplier is applicable to at least some prizes awardable in the second feature event. Preferably a value of the multiplier is calculated in accordance with a predetermined or random calculation scheme. The calculation scheme may provide a substantially inverse relationship between the value of the multiplier and the feature event win value.

One embodiment includes the step of comparing the feature event win value to the threshold value and, if the feature event win value is less than or equal to the threshold value, implementing a guarantee that the second feature event will trigger when a set amount of gameplay is reached without the second feature event having been triggered within the set amount of gameplay.

In one embodiment the threshold value is a constant predefined value, for example zero. In another embodiment the threshold value is randomly determined.

One embodiment further includes the steps of:

defining a gaming participation threshold level;

determining a gaming participation level for the player; and making the provision of the triggerable second feature event contingent upon the player's gaming participation level being equal to, or greater than, the gaming participation threshold level.

The method may be triggered by a triggering bet. Preferably the threshold value is dependent upon a bet placed by the player, which may be the triggering bet. Alternatively, the bet upon which the threshold value may be dependent may be a side bet placed at the commencement of the first feature event. In one embodiment the threshold value is equal to a first factor multiplied by the bet upon which the threshold value is dependent.

Preferably the second feature event includes any one or more of: at least one free game; at least one re-spin; use of a bonus play screen; the provision of a prize; the provision of a jackpot prize; and/or use of at least one wild feature.

Additionally or alternatively the second feature event may include any one or more of: at least one extraneous game from the main game; a bonus game; and/or a high payout game.

An embodiment includes the steps of:

defining a plurality of threshold ranges; and defining at least one parameter of the second feature event in dependence upon a particular threshold range in which the feature event win value falls.

According to a second aspect of the invention there is provided a gaming method for use with a gaming apparatus configured to provide a first feature event, the method including the steps of:

defining a threshold value;

conducting the first feature event, or part thereof, so as to determine a feature event win value; and comparing the feature event win value to the threshold value and, if the feature event win value is less than or equal to the threshold value, providing a second feature event that is guaranteed to trigger when a set amount of gameplay is reached without the second feature event having been triggered within the set amount of gameplay.

Preferably the set amount of gameplay is calculated in accordance with a predetermined or random calculation scheme. The calculation scheme may provide a substantially inverse relationship between the set amount of gameplay and the feature event win value.

An embodiment includes the steps of:

defining a plurality of threshold ranges; and defining the set amount of gameplay in dependence upon the threshold range in which the feature event win value falls.

According to a third aspect of the invention there is provided a gaming method for use with a gaming apparatus configured to provide a first feature event, the method including the steps of:

defining a threshold value;

conducting the first feature event, or part thereof, so as to determine a feature event win value; and comparing the feature event win value to the threshold value and, if the feature event win value is less than or equal to the threshold value, taking the following steps:

making a plurality of player selectable options available;

receiving a player input selecting one of said options; and implementing at least one of said options in response to said input.

In one embodiment the player selectable options include: the award of a bonus prize; the provision of a triggerable second feature event; and the provision of a second feature event that is guaranteed to trigger when a set amount of gameplay is reached without the second feature event having been triggered within the set amount of gameplay.

According to a fourth aspect of the invention there is provided computer executable code for instructing a computer to perform any one of the methods described above.

According to a fifth aspect of the invention there is provided a non-transitory computer readable storage medium storing computer executable code as described above.

According to a sixth aspect of the invention there is provided a computing apparatus having a central processing unit, associated memory and storage devices, and input and output devices, the apparatus being configured to perform a method as described above.

According to a seventh aspect of the invention there is provided gaming apparatus including:

a component for defining a threshold value;

a component for conducting at least part of a first feature event so as to determine a feature event win value, said first feature event having a prize award potential; and a component for comparing the feature event win value to the threshold value and, if the feature event win value is less than or equal to the threshold value, providing a triggerable second feature event, whereby the second feature event has a prize award potential that is greater than the prize award potential of the first feature event.

According to an eighth aspect of the invention there is provided gaming apparatus including:

a component for defining a threshold value;

a component for conducting at least part of a first feature event so as to determine a feature event win value; and a component for comparing the feature event win value to the threshold value and, if the feature event win value is less than or equal to the threshold value, providing a second feature event that is guaranteed to trigger when a set amount of gameplay is reached without the second feature event having been triggered within the set amount of gameplay.

According to a ninth aspect of the invention there is provided a gaming system including:

a component for defining a threshold value;

a component for conducting at least part of a first feature event so as to determine a feature event win value, said first feature event having a prize award potential; and a component for comparing the feature event win value to the threshold value and, if the feature event win value is less than or equal to the threshold value, providing a triggerable second feature event, whereby the second feature event has a prize award potential that is greater than the prize award potential of the first feature event.

According to another aspect of the invention there is provided a gaming system including:

a component for defining a threshold value;

a component for conducting at least part of a first feature event so as to determine a feature event win value; and a component for comparing the feature event win value to the threshold value and, if the feature event win value is less than or equal to the threshold value, providing a second feature event that is guaranteed to trigger when a set amount of gameplay is reached without the second feature event having been triggered within the set amount of gameplay.

An embodiment of the above system further includes a central control for running a gaming algorithm, and a plurality of remote clients in communication with the central control over a communications network, the remote clients including screens for the display of information to players.

Embodiments of the present invention may be applied to any suitable type of gaming system or platform. It can apply to stand-alone gaming apparatus, e.g. electronic gaming machines, such as video gaming machines, to gaming machines that are linked together, e.g. via a network such as an intranet, and/or to gaming systems provided through computing or other electronic devices, e.g. personal computers, PDAs, mobile telephones, digital televisions, and the like, e.g. over the Internet or other communications networks.

The present invention may be applied to gaming apparatus that plays any suitable game, e.g. slot-machine type games, poker, keno, blackjack, bingo, roulette, pachinko, or the like.

In some networked embodiments of the invention, the central control may conduct the games and manage the accounting and the like, and a number of remote terminals/clients merely provide the user input and display mechanisms. In other networked embodiments of the invention, the control of the games and various other features may be carried out at the remote terminals, or may be split between the central control and the remote terminals.

It should be noted that any of the features of any of the aspects mentioned above may be combined with any other features mentioned above, as appropriate.

Embodiments of the present invention will now be described, by way of example only, with reference to the accompanying drawings. It is to be understood that the particularity of the detailed description and the drawings does not supersede the generality of the preceding description of the invention.

BRIEF DESCRIPTION OF THE ACCOMPANYING DRAWINGS

DETAILED DESCRIPTION OF PREFERRED EMBODIMENTS OF THE INVENTION

Figure 1:
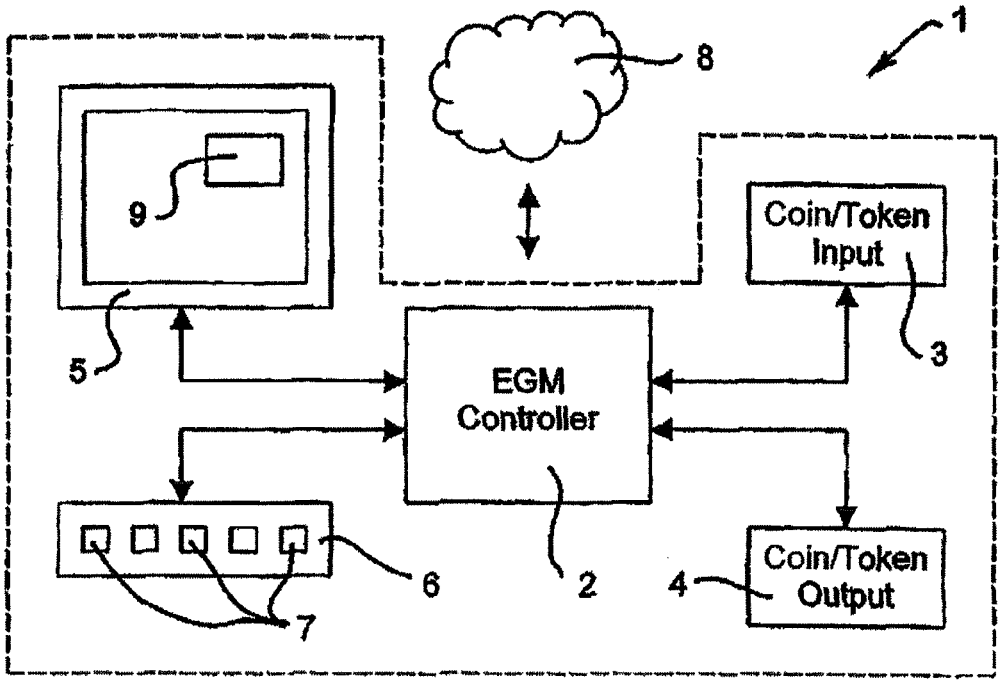
FIG. 1 is a block diagram of gaming apparatus according to one embodiment of the present invention.

Referring to FIG. 1, gaming apparatus, which in this case takes the form of an electronic gaming machine (EGM) 1, includes various standard components, such as a controller 2 for controlling the operation of the EGM 1 and the games run on it, a note/coin/token input 3 for receiving bets, a note/coin/token output 4 for paying out winnings, a display 5 for displaying game screens, and player input means 6 for allowing user interaction, which may include e.g. buttons 7 and which may e.g. be provided as part of the display 5 in a touch-screen type manner.

The EGM 1 may be a stand-alone machine. It may also be networked with other EGMs and/or a control centre via a suitable communications network 8, such as a LAN and/or WAN, in order to play networked (e.g. intranet or Internet) games, such as a linked jackpot.

Figure 2:
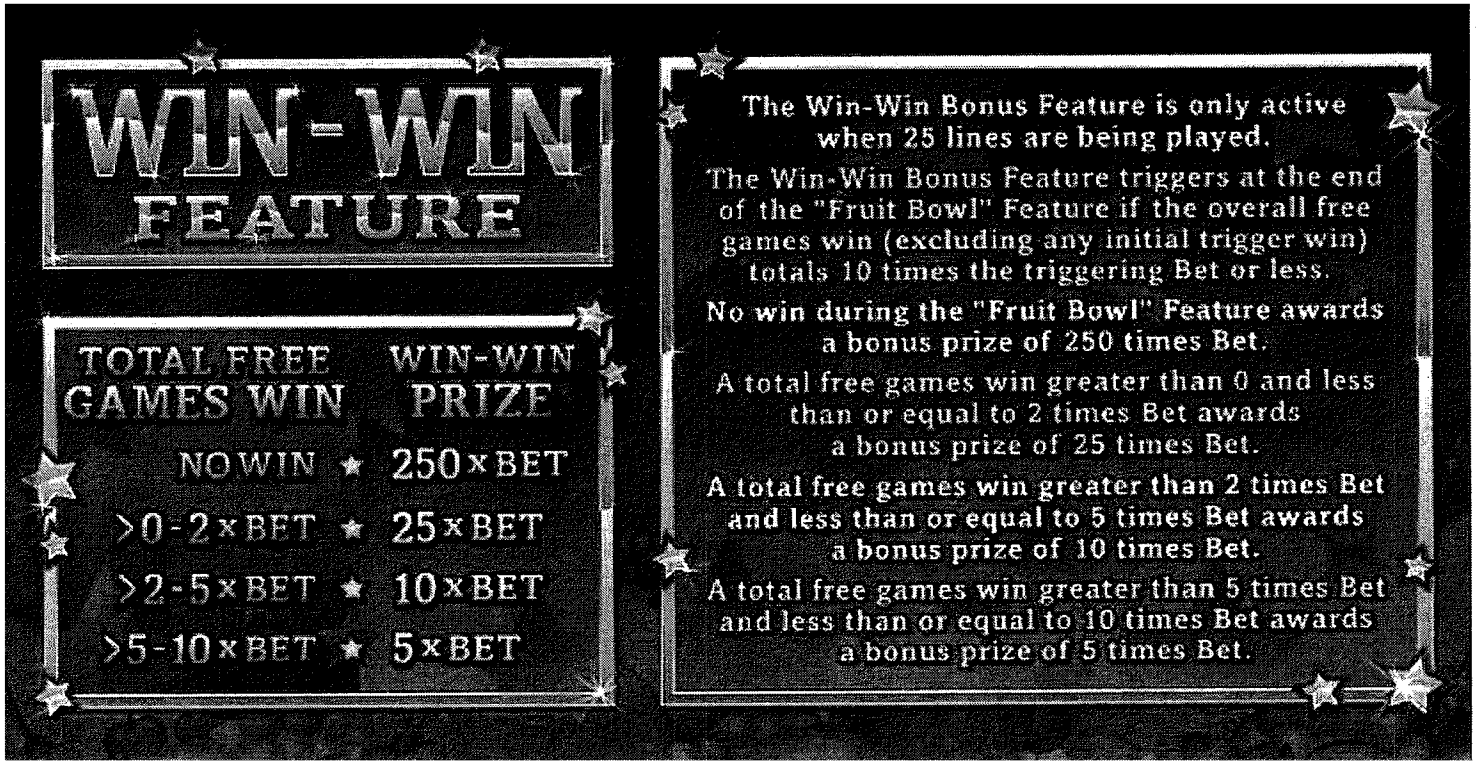
FIG. 2 is a generic gaming display screen shot according to an embodiment of the present invention.

In use, the EGM 1 will display an initial gaming screen on the display 5. A player will insert bank notes, coins and/or tokens into the EGM input 3, and will press a button 7 to initiate play of the main game provided by the EGM. How matters then proceed will depend on the type of main game being played. For example, FIG. 2 illustrates a game screen from a slot machine-type game, in which the EGM 1 displays virtual reels 10 of symbols 11, and spins and stops these reels 10 in various win and lose symbol combinations on one or more paylines 12 in accordance with a stored gaming algorithm and random number generator. In an alternative embodiment (not illustrated) the main game is a poker-type game, in which a player will receive a number of cards with which to play for a winning hand. It will be appreciated that other types of main games may be provided, such as keno, blackjack, bingo, roulette, pachinko, or the like. For the purposes of this detailed description, the main focus shall be upon an embodiment providing a slot machine-type main game.

The player may interact via the buttons 7, so as e.g. to spin or hold reels and otherwise play the main game. A common element will be win events, e.g. particular symbol combinations that pay out a prize or jackpot.

Also, in order to increase interest, the main game is capable of providing feature events that consist of a plurality of feature games, which may or may not relate directly to the main game being played, and that generally provide a prize of some sort. These feature events may include for example one or more free games, a re-spin (similar to a free game but with one or more reels held on a slot device), and the chance to play for higher winnings or the like. They may be e.g. luck or skills based. They may be provided as "second screen" features that display on a new screen, and may be extraneous to the main game.

Another way of adding gaming interest is for a main game or a feature event to include one or more wild symbols that can represent more than one type of symbol or card, and so can increase the chances of achieving a winning combination or the like. Similarly, for embodiments in which the main game is a card game, wild cards may be provided.

These win and feature events can be arranged to occur due to the usual operation of the main game randomly or under a particular set of circumstances, e.g. under a set symbol or card combination. They may also occur due to an accumulation of circumstances across a number of games, and may occur due to the condition of a device supplemental to the EGM 1 itself, e.g. they may relate to jackpot wins in linked jackpot systems comprising a plurality of EGMs under a central control.

FIG. 1 illustrates an essentially stand-alone electronic gaming machine (albeit with the potential for networked connectivity). However, another embodiment provides a gaming system including networked computing apparatus having a central processing unit disposed at a central control computer. A plurality of remote clients is in communication with the central control computer over a communications network such as a local area network and/or a wide area network. Each of the remote clients has at least one screen for the display of information to a player and input means allowing for player interaction with the central control.

The central control computer has access to associated memory and storage devices. The central control computer also has access to computer executable code for instructing the central control computer to run the gaming algorithm that performs the embodiment of the inventive method. In one embodiment the computer executable code is in the form of software and associated data, which are stored upon a non-transitory computer-readable medium in the form of one or more compact disks. Alternative embodiments make use of other forms of computer readable storage media, such as Digital Versatile Discs (DVD's), hard drives, flash memory, Erasable Programmable Read-Only Memory EPROM, and the like. Alternatively, the software and its associated data may be stored as one or more downloadable or remotely executable files that are accessible via a computer communications network such as the internet.

The embodiment of the present invention provides a bonus scheme associated with a gaming process that is a feature event which provides a plurality of feature games. This may consist of a single type of feature game that is provided more than once, or may consist of more than one type of feature game, with each type of feature game being provided once or more than once. At appropriate times during play of the main game or the feature event, the player may use the input means 6 to indicate that the player wishes to review the rules of the bonus scheme, which is referred to in this embodiment as the WIN-WIN FEATURE. This results in the screen shot shown in FIG. 2 being presented to the player on display 5.

Figure 3:
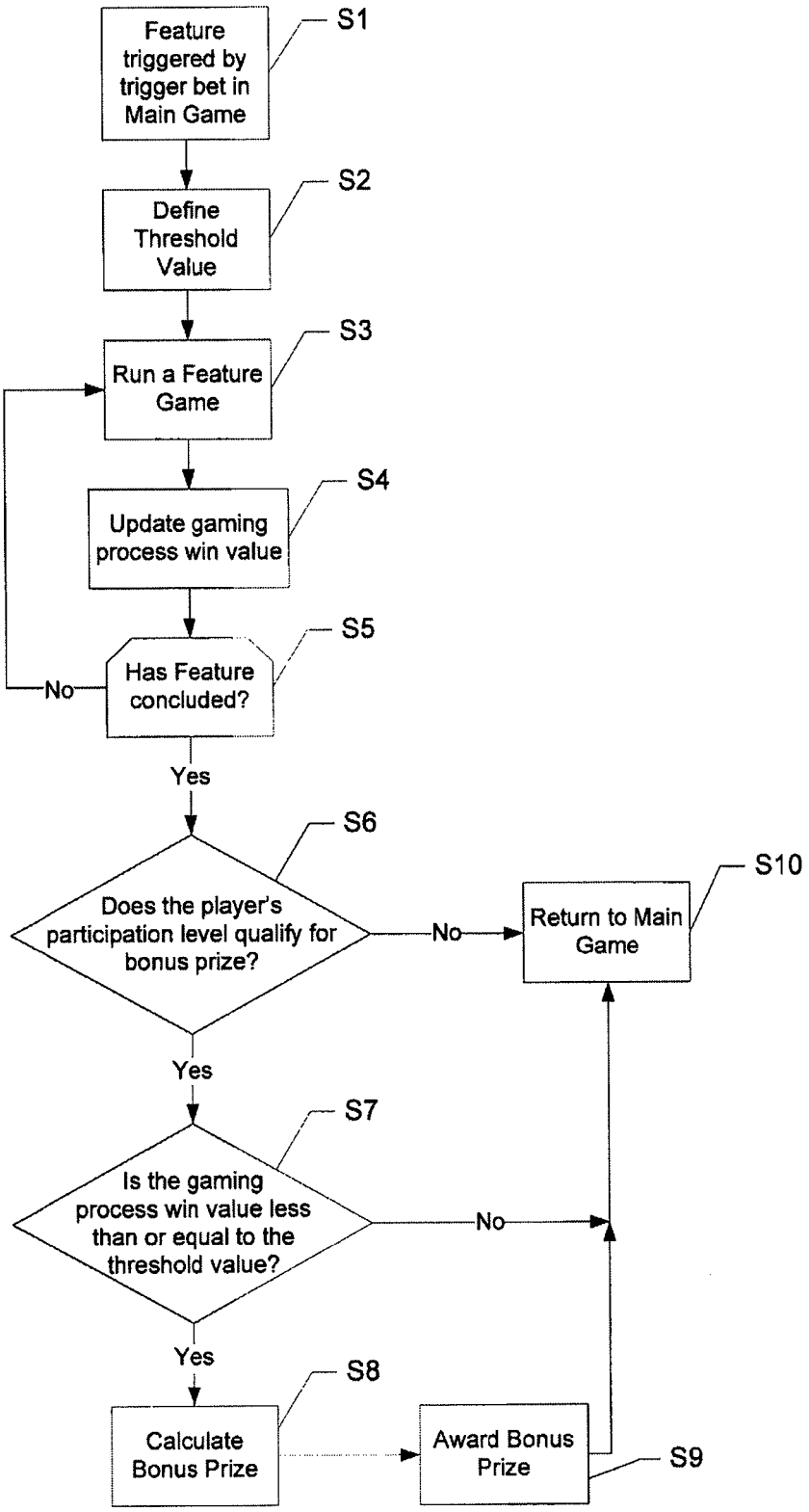
FIG. 3 is a flow diagram of a gaming control process in accordance with an embodiment of the present invention.
Figure 4:
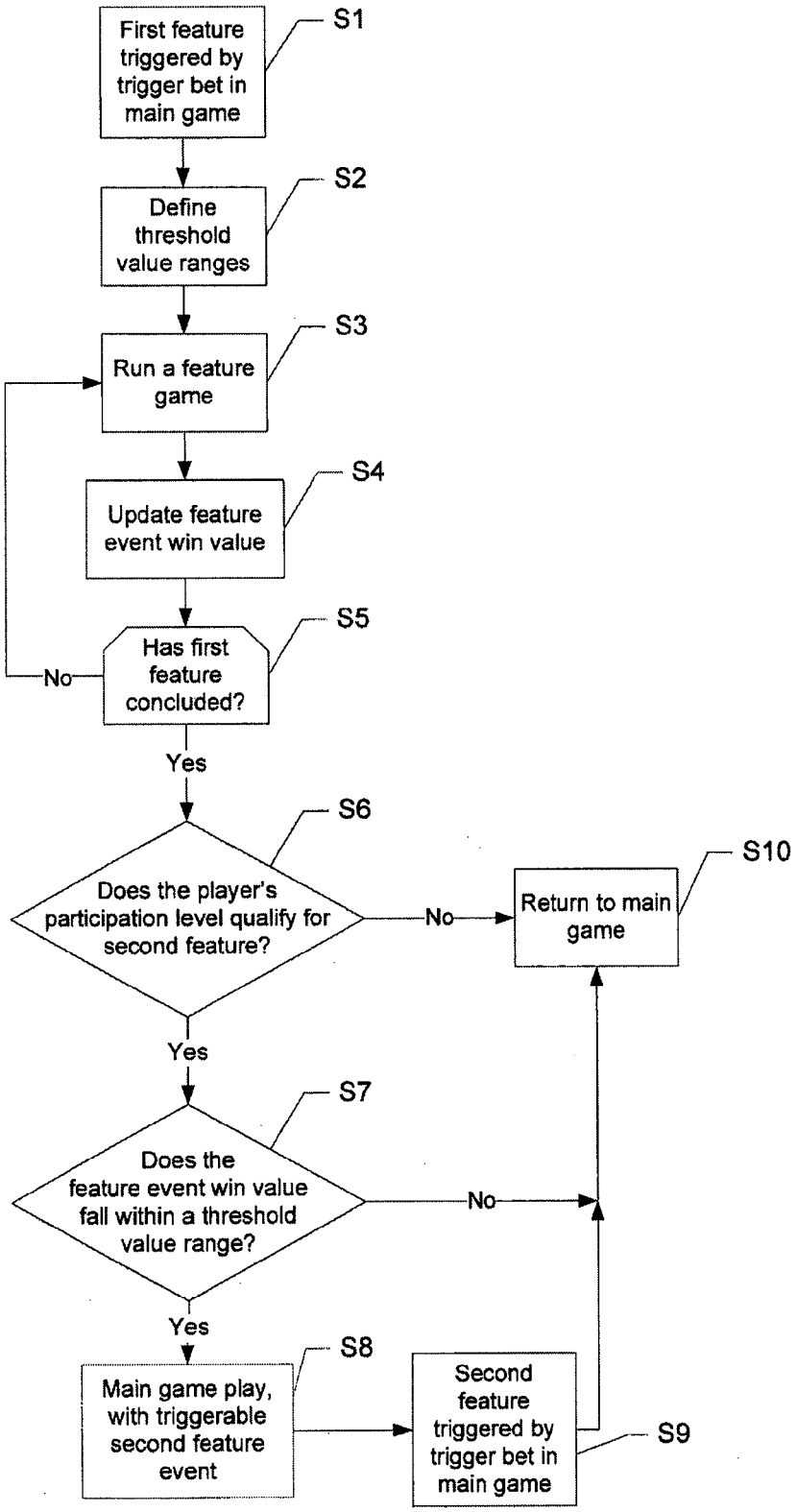
FIG. 4 is a flow diagram of a gaming control process in accordance with another embodiment of the present invention.

In accordance with some embodiments of the present invention, the EGM 1 includes within the gaming algorithm components for taking the various method steps that are depicted in flowchart form in any one or more of FIGS. 3, 4 and/or 5.

The flowchart of FIG. 3 assumes that the main game is being played by the player and at some point a feature event is triggered by a bet placed on the main game by the player. This is represented by Step S1 on the flow chart. At this step the amount of the triggering bet, and the number of lines on which the trigger bet was placed, are stored at a predefined memory address in random access memory that is accessible to the processor in the EGM controller 2. For the sake of a running example, we shall assume that the amount of the trigger bet was $2.00 (or the equivalent in credits) and that this bet was placed on all 25 lines of the main slot machine game.

At Step S2 the processor defines the threshold value. In this embodiment the threshold value is equal to the trigger bet value multiplied by a first factor of ten. Hence, in the running example, the threshold value is $20.00 (i.e. $2.00 multiplied by 10). The threshold value is stored at a predefined memory address in random access memory that is accessible to the processor. At this step the processor also sets a variable known as the gaming process win value to zero. This variable is stored at another memory address.

At Step S3 the processor commences running of a gaming process in the form of the feature event, which consists of a number of feature games. Each of these games may, or may not, result in the award of monetary prizes (or the equivalent in credits) to the player. After each game, at Step S4, the processor adds the amount won in the preceding game to the gaming process win value so as to keep track of the total amount won by the player in the feature games. For the running example we shall assume that the total amount won by the player by the conclusion of the feature games is $3.00 (or the equivalent in credits).

At Step S5 the loop limiter determines whether the required number of feature games has been played. If not, the processor loops back to Step S3. If the required number of feature games has been played the processor moves onto Step S6. This step makes the award of the bonus prize to the player contingent upon the player's gaming participation level. In the current embodiment, the gaming participation threshold level is defined with regard to the number of lines of the bet on the main slot machine game that triggered the feature event. That is, the triggering bet must have been placed on all 25 lines for the play to potentially qualify for a bonus prize. Hence, the processor accesses the memory address at which the number of lines of the trigger bet is stored in order to determine a gaming participation level for the player. The processor then compares this value to the predefined gaming participation threshold level of 25. If the two values are equal, then the player qualifies for a possible award of a bonus prize and the processor moves onto Step S7. If the two values are not equal, then the processor moves to Step S10, which consists of returning to the main game. In the running example the trigger bet was on all 25 lines and hence the player qualifies for a chance at being awarded the bonus prize.

At Step S7 the processor accesses the memory addresses at which the gaming process win value and the threshold value were stored. These two values are compared and, if the gaming process win value is greater than the threshold value, the player is not awarded the bonus prize and the processor moves to Step S10. If the gaming process win value is less than, or equal to, the threshold value, the processor moves to Step S8. In the running example, the gaming process win value is $3.00, which is less than the threshold value of $20.00. Hence, a bonus prize must be awarded to the player.

At Step S8 the processor calculates the amount of the bonus prize. Firstly the processor accesses the memory addresses at which the gaming process win value and the trigger bet amount were stored. The processor then determines in which range the gaming process win value falls with reference to some predetermined ranges. The resultant range determines a second factor in accordance with the following look up table:

| Gaming Process Win Value Range | Second Factor |
|---|---|
| Zero | 250 |
| Greater than zero to 2 times the trigger bet amount | 25 |
| Greater than 2 times the trigger bet amount to 5 times the trigger bet amount | 10 |
| Greater than 5 times the trigger bet amount to 10 times the trigger bet amount | 5 |

With reference to the running example, in which the trigger bet amount is $2.00, this look up table is as follows:

| Gaming Process Win Value Range | Second Factor |
|---|---|
| Zero | 250 |
| Greater than zero to $4.00 | 25 |
| Greater than $4.00 to $10.00 | 10 |
| Greater than $10.00 to $20.00 | 5 |

In the running example the gaming process win value was $3.00, which falls within the range of "Greater than zero to $4.00". Hence, for the running example the second factor is 25. To calculate the amount of the bonus prize, the processor multiplies the trigger bet amount by the second factor. Hence, in the running example, the amount of the bonus prize is $50.00.

It will be appreciated from the above tables that as the win value range increases, the second factor decreases. Hence, this scheme for calculation of the amount of the bonus prize provides a substantially inverse relationship between the value of the bonus prize and the gaming process win value, albeit in a staggered and approximate manner as opposed to a mathematically perfect inverse relationship. As used in this document the term 'inverse relationship' is to be construed as including staggered, approximate and mathematically imperfect relationships. In other embodiments the determination of the value of the bonus prize at Step S8 is via a predetermined or random calculation scheme.

At Step S9 the bonus prize is awarded to the player. This may be in the form of is any one or more of game credits, cash, a physical prize, extra free games, a jackpot and/or a re-play of the feature, provided that the total value of the bonus prize is equal to the amount calculated in Step S8. Once the prize has been awarded the processor moves onto Step S10 and returns to the main game.

In the above embodiment the threshold value was determined at Step 2 by multiplying the trigger bet by a first factor of ten. However, in another embodiment the threshold value has a predetermined constant value. For example, if the threshold value is set to zero, then the bonus prize is only awardable if the player wins nothing in the feature event. In other words, if the threshold value is zero then the gaming process win value must also be zero in order to satisfy the test at Step S7. In a further embodiment the threshold, value is dependent upon a side bet placed at the commencement of the feature event. Such a side bet may be a secondary bet that is optional or compulsory.

In yet another embodiment, the threshold value is randomly determined at Step S2 from amongst a range of possible values. As used in this document, including in the claims, the terms "random", "randomly", "randomized", and the like, are to be construed as connoting either a purely random process or a "pseudo-random" process. An example of a pseudo-random process includes the determination by a computer processor of a pseudo-random number in response to an output of a digital clock.

In the embodiment shown in FIG. 3 the routine to determine whether to award the bonus prize (i.e. Steps S6 and S7) is performed after the feature event has concluded and the gaming process win value that is used in the routine is the sum of the winnings from all of the feature games in the feature event. However in an alternative embodiment the routine is conducted at predefined points, or randomly determined points, throughout the feature event. In this embodiment the gaming process win value that is used in the routine is the sum of the winnings from only the relevant part of the feature event. For example, the routine to determine whether to award the bonus prize may be performed at the conclusion of each pair of feature games during the feature event. In this case the gaming process win value that is used in the routine is the sum of, the player's winnings solely from the preceding pair of feature games. In this alternative embodiment, the player may be given more than one chance to win a bonus prize for each feature event that is triggered.

Referring to FIG. 4, the player commences play of the main game. Eventually a bet placed on the main game by the player results in triggering of the first feature event, as shown at Step S1. That bet is referred to herein as a 'triggering bet'.

The process flow then proceeds to Step S2, at which a threshold value is defined. In some embodiments the threshold value is a constant predefined value such as zero and in some other embodiments the threshold value is randomly determined and/or dependent upon a side bet placed at the commencement of the first feature event. Such side bets may be compulsory, optional or automatically taken without the player's knowledge. In the embodiment that will be described in more detail below with reference to FIG. 4, four threshold ranges are defined, which are based on factors multiplied by the amount of the triggering bet that was placed by the player. These ranges are as follows:

Zero;

Greater than zero to 2 times the trigger bet;

Greater than 2 times the trigger bet to 5 times the trigger bet; and

Greater than 5 times the trigger bet to 10 times the trigger bet.

The processor then loops through Steps S3, S4 and S5 in order to provide the first feature event. Each loop commences at Step S3 with the playing of a feature game, which may or may not result in a win. Each time the processor loops through Step S4, the feature event win value is updated so as to accumulate any amount won in the feature game that has just been executed at Step S3. The looping continues until all of the feature games of the first feature event have been played. In this preferred embodiment a total of 10 free feature games are provided, with any winnings arising from those 10 games being subject to a multiplier of 2. In other words, any winnings achieved during the 10 feature games of the first feature event are doubled.

The first feature event has a known prize award potential, which can be calculated by those skilled in the art based on the feature game parameters, such as the amounts of awardable prizes and the associated probabilities, the number of feature games provided in the feature event, the multiplier applied to the winnings, etc. In some embodiments the prize award potential is the average expected return-to-player provided by the feature event, however other metrics may be utilised in other embodiments.

At Step S6 of FIG. 4 the player's participation level is checked in the manner described in more detail above in relation to Step S6 of FIG. 3, except in the embodiment of FIG. 4 it is the provision of a triggerable second feature event that is contingent upon the player's gaming participation level being equal to, or greater than, a predefined gaming participation threshold level. If the player's participation level is insufficient, the process flow proceeds to Step S10, which is a return to main game play. If the player's participation level is sufficient, the process flow proceeds to Step S7.

At Step S7 of FIG. 4 the processor compares the feature event win value to the threshold value ranges. If the feature event win value exceeds the upper limit of the highest threshold value range, then the process flow returns to the main game at Step S10. If the comparison at Step S7 determines that the feature event win value falls within one of the threshold value ranges, then the player qualifies for further main game play, at Step S8, which is capable of triggering a second feature event, at Step S9.

Any type of feature event may be provided as the second feature event. For example, the second feature event may include: free games; re-spins; use of a bonus play screen; the provision of a prize, including a jackpot prize; and/or use of at least one wild feature. Further, the second feature event may include any one or more of: at least one extraneous game from the main game; a bonus game; and/or a high payout game.

The second feature event is tailored so as to have a greater prize award potential as compared to that of the first feature event. In other words, the parameters of the second feature event are selected so as to advantageously influence the average return-to-player of the second feature event as compared to that of the first feature event. Hence, the player can be assured that if the first feature event results in a sufficiently low total win, then the player will qualify for the opportunity to subsequently trigger a second feature event that is more potent than the first feature event.

In some embodiments the extent to which the prize award potential of the second feature event is more potent is dependent upon the particular threshold value range that the feature event win value fell within. This is achieved by defining game parameters for the second feature event in dependence upon the relevant range. For example, the number of free games provided by the second feature event may be calculated within reference to a look up table such as the following:

| Threshold Value Range | Number of Games |
|---|---|
| Zero | 50 |
| Greater than zero to 2 times the trigger bet | 25 |
| Greater than 2 times the trigger bet to 5 times the trigger bet | 20 |
| Greater than 5 times the trigger bet to 10 times the trigger bet | 15 |

The values in the look up table above provide an approximate and staggered inverse relationship between the threshold value range in which the feature event win value falls and the associated number of free games to be provided by the second feature game once it has been triggered.

As an alternative to use of such a look up table, the number of games provided by the second feature event may be determined by a predetermined or random calculation scheme. For example, the number of games provided by the second feature event may be randomly selected from a range of numbers, for example ranging between 15 and 50. Preferably, the calculation scheme is such that the number of games provided by the second feature event exceeds the 10 games provided by the first feature event. All other parameters being equal, this allows the second feature event to have a greater prize award potential as compared to that of the first feature event.

Another way in which the prize award potential of the second feature event may be influenced is by defining a value of a multiplier in dependence upon the threshold value range in which the feature event win value fell, such as in the look up table below:

| Threshold Value Range | Multiplier |
|---|---|
| Zero | 6 |
| Greater than zero to 2 times the trigger bet | 5 |
| Greater than 2 times the trigger bet to 5 times the trigger bet | 4 |
| Greater than 5 times the trigger bet to 10 times the trigger bet | 3 |

The values in the look up table above provide an approximate and staggered inverse relationship between the threshold value range in which the feature event win value falls and the value of the multiplier that is applied to the prizes awarded during the second feature event. The lowest multiplier in the above table, 3, is nevertheless higher than the multiplier of 2 that is applied to winnings arising in the first feature event.

As an alternative to use of such a look up table, the multiplier used during the second feature event may be determined by a predetermined or random calculation scheme. For example, the multiplier may be randomly selected from a range of numbers, for example ranging between 4 and 10.

Another way in which the prize award potential of the second feature event may be influenced is by making the operation of wild or other high paying symbols in the second feature event dependent upon the threshold value range in which the feature event win value fell. For example, this may define the number of times that wild symbols and/or other high paying symbols are used in the feature games of the second feature event.

Figure 5:
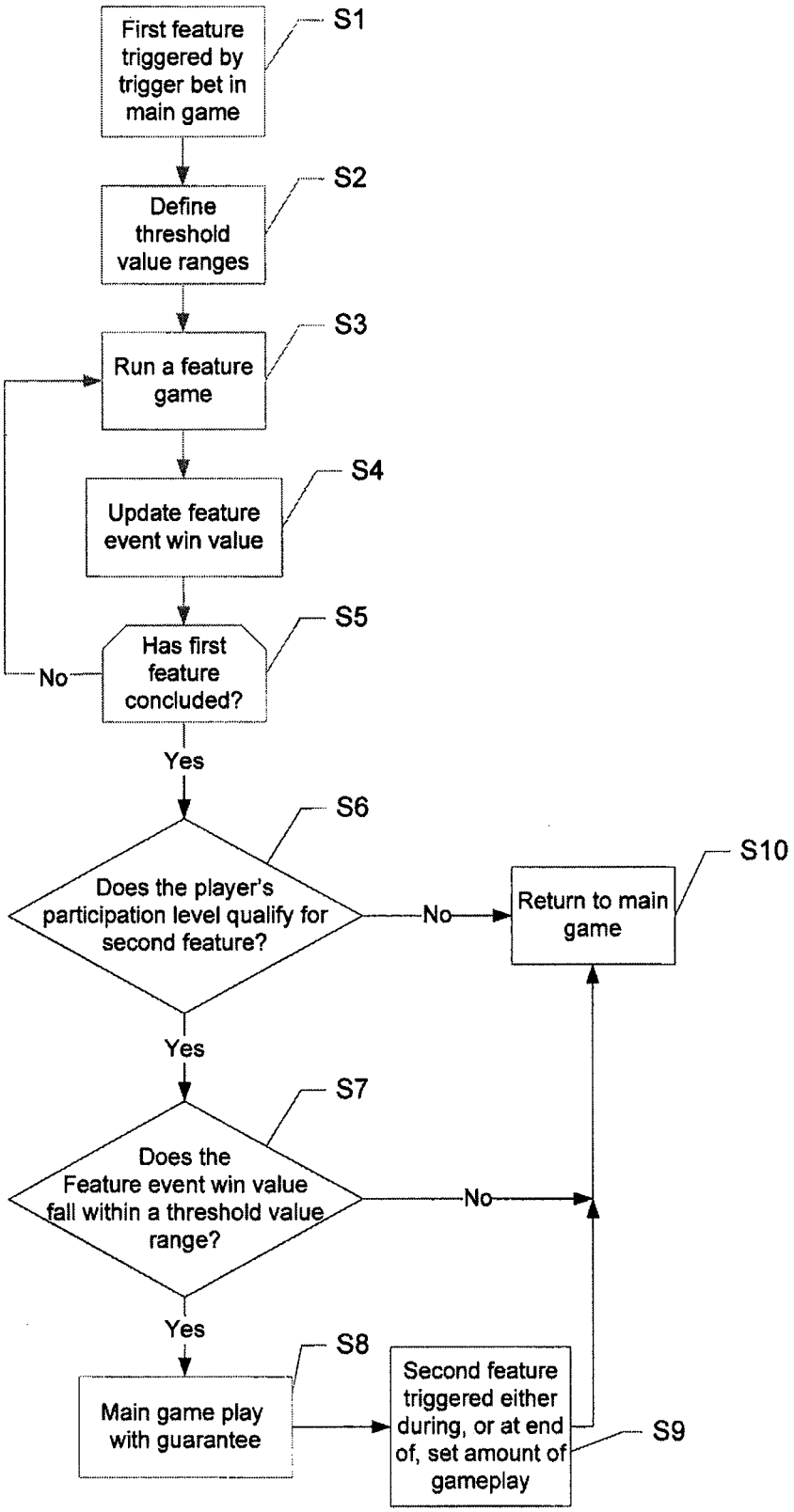
FIG. 5 is a flow diagram of a gaming control process in accordance with yet another embodiment of the present invention.

FIG. 5 illustrates another embodiment of the invention that is generally similar to that of FIG. 4; however it differs with regard to the manner in which the second feature event may be triggered. Hence, Steps S1 to S7 of FIG. 5 are as described above with reference to FIG. 4. However, once the process flow reaches Step S8 of FIG. 5 (i.e. once a determination is made at Step S7 that the feature event win value falls within one of the threshold value ranges) a guarantee is implemented as play of the main game re-commences. This guarantee is based on the guarantee that is described in more detail in the applicant's granted Australian Patent No. 2004281073, the contents of which are hereby incorporated in their entirety by way of reference.

The guarantee is that the second feature event will have triggered in one of two possible ways once a set amount of gameplay is reached. The first way in which the second feature game may be triggered at Step S9 of FIG. 5 is due to the normal feature triggering rules of the main game and this may occur at any point within the set amount of gameplay. The second way in which the second feature game may be triggered at Step S9 of FIG. 5 arises if normal triggering does not occur once the set amount of gameplay has been reached. If so, the second feature event is triggered, regardless of the normal feature triggering rules of the main game.

Gameplay may be measured based on any suitable parameter that is indicative of an amount of gameplay, such as the number of games played, the amount of bets laid, the number of lines played in a slot machine type game, the number of hands played in a card machine type game, etc.

In one embodiment the set amount of gameplay is calculated in accordance with a predetermined calculation scheme. For example, the second feature event is guaranteed to have triggered once a predetermined number, such as 100, of main games have been played at Step S8. Alternatively, the second feature event may be guaranteed to have triggered once a randomly determined number of main games have been played at Step S8. This random determination may be selected from within a predetermined range, such as between 50 and 150 games.

In another embodiment the set amount of gameplay is calculated in dependence upon the particular threshold value range in which the feature event win value fell. This may be achieved with the use of the following look up table:

| Threshold Value Range | Set Amount of Gameplay |
|---|---|
| Zero | 25 |
| Greater than zero to 2 times the trigger bet | 50 |
| Greater than 2 times the trigger bet to 5 times the trigger bet | 75 |
| Greater than 5 times the trigger bet to 10 times the trigger bet | 100 |

The values in the look up table above provide an approximate and staggered inverse relationship between the threshold value range in which the feature event win value falls and the set amount of gameplay. Hence, using the above figures, if a player wins nothing in the first feature event, they can return to play of the main game at Step S8 of FIG. 5 confident in the knowledge that the second feature event is guaranteed to be triggered either during, or at the completion of, the next 25 plays of the main game.

In one embodiment, the guarantee is only applicable to the next triggering of the second feature event. That is, once the second feature event has been triggered (either due to the normal triggering rules of the main game or because the set amount of gameplay has been reached), then the guarantee is no longer applicable and the process flow returns to normal play of the main game at Step S10.

In some embodiments of the method of FIG. 5 the second feature event need not have a prize award potential that is greater than that of the first feature event. In other words, the provision of the guarantee alone is considered to be the benefit conferred to the player due to the low performing first feature event. However, in other embodiments, the benefit consists of eligibility for a second feature event with a higher prize award potential, the provision of a guarantee and the immediate award of a bonus prize. Indeed, it will be appreciated that embodiments of the invention may be configured so as to provide the player with any combination of one, two or three of these benefits.

Another embodiment of the invention allows the player to select the benefit that they wish to receive due to a low performing first feature event. In this embodiment (not illustrated), the process flow of Steps S1 to S7 is as described above with reference to FIG. 4. However, once the process flow reaches the equivalent of Step S8, the gaming apparatus 1 makes a plurality of player selectable options available. For example, once the processor determines that the feature event win value either exceeds the threshold value (as in Step S7 of FIG. 3) or falls within a threshold value range (as in Step S7 of FIG. 4 or 5), a list containing the following three options is effectively presented to the player on display 5:

1. An immediate award of a bonus prize (as described above in relation to FIG. 3);
2. The provision of a triggerable second feature event having a greater prize award potential than that of the first feature event (as described above in relation to FIG. 4); or
3. The provision of a guarantee that the second feature event will trigger when a set amount of gameplay is reached without the second feature event having been triggered within the set amount of gameplay (as described above in relation to FIG. 5).

The processor 2 then gives the player an opportunity to use input means 6 to select one of these options. This causes an input signal to be communicated to the processor 2, which is programmed to respond to the input signal by implementing the player selected option.

It is to be understood that various alterations, additions and/or modifications may be made to the parts previously described without departing from the ambit of the present invention, and that, in the light of the above teachings, the present invention may be implemented in software, firmware and/or hardware in a variety of manners as would be understood by a person skilled in the art.

The invention claimed is:

1. A gaming method for use with a gaming apparatus configured to provide a first feature event having a prize award potential, the method including the steps of:

using the gaming apparatus to define a threshold value;

using the gaming apparatus to conduct the first feature event, or part thereof, so as to determine a feature event win value; and using the gaming apparatus to compare the feature event win value to the threshold value and, if the feature event win value is less than or equal to the threshold value, providing a triggerable second feature event, whereby the second feature event has a prize award potential that is greater than the prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

2. A gaming method according to claim 1 wherein a number of feature games provided by the second feature event exceeds a number of feature games provided by the first feature event.

3. A gaming method according to claim 1 including the step of comparing the feature event win value to the threshold value and, if the feature event win value is less than or equal to the threshold value, implementing a guarantee that the second feature event will trigger when a set amount of gameplay is reached without the second feature event having been triggered within the set amount of gameplay.

4. A method according to claim 1 wherein the threshold value is a constant predefined value.

5. A method according to claim 4 wherein the threshold value is zero.

6. A method according to claim 1 wherein the threshold value is randomly determined.

7. A method according to claim 1 further including the steps of:

defining a gaming participation threshold level;

determining a gaming participation level for the player; and making the provision of the triggerable second feature event contingent upon the player's gaming participation level being equal to, or greater than, the gaming participation threshold level.

8. A method according to claim 1 wherein the method is triggered by a triggering bet.

9. A method according to claim 8 wherein the threshold value is dependent upon a bet placed by the player.

10. A method according to claim 9 wherein the bet upon which the threshold value is dependent is the triggering bet.

11. A method according to claim 9 wherein the bet upon which the threshold value is dependent is a side bet placed at the commencement of the first feature event.

12. A method according to claim 9 wherein the threshold value is equal to a first factor multiplied by the bet upon which the threshold value is dependent.

13. A method according to claim 1 wherein the second feature event includes any one or more of: at least one free game; at least one re-spin; use of a bonus play screen; the provision of a prize; the provision of a jackpot prize; or use of at least one wild feature.

14. A method according to claim 1 wherein the second feature event includes any one or more of: at least one extraneous game from the main game; a bonus game; or a high payout game.

15. A method according to claim 1 including the steps of:

defining a plurality of threshold ranges; and defining at least one parameter of the second feature event in dependence upon the particular threshold range in which the feature event win value falls.

16. A gaming method for use with a gaming apparatus configured to provide a first feature event, the method including the steps of:

using the gaming apparatus to define a threshold value;

using the gaming apparatus to conduct the first feature event, or part thereof, so as to determine a feature event win value; and using the gaming apparatus to compare the feature event win value to the threshold value and, if the feature event win value is less than or equal to the threshold value, providing a second feature event that is guaranteed to trigger when a set amount of gameplay is reached without the second feature event having been triggered within the set amount of gameplay;

wherein the set amount of gameplay is calculated in accordance with a calculation scheme that provides an inverse relationship between the set amount of gameplay and the feature event win value.

17. A method according to claim 16 including the steps of:

defining a plurality of threshold ranges; and defining the set amount of gameplay in dependence upon the threshold range in which the feature event win value falls.

18. Computer executable code for instructing a computer to perform a method including the steps of:

using the computer to define a threshold value;

using the computer to conduct a first feature event, or part thereof, so as to determine a feature event win value; and using the computer to compare the feature event win value to the threshold value and, if the feature event win value is less than or equal to the threshold value, providing a triggerable second feature event, whereby the second feature event has a prize award potential that is greater than a prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

19. A non-transitory computer readable storage medium storing computer executable code for instructing a computer to perform a method including the steps of:

using the computer to define a threshold value;

using the computer to conduct a first feature event, or part thereof, so as to determine a feature event win value; and using the computer to compare the feature event win value to the threshold value and, if the feature event win value is less than or equal to the threshold value, providing a triggerable second feature event, whereby the second feature event has a prize award potential that is greater than a prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

20. One or more downloadable or remotely executable files containing computer executable code for instructing a computer to perform a method including the steps of:

using the computer to define a threshold value;

using the computer to conduct a first feature event, or part thereof, so as to determine a feature event win value; and using the computer to compare the feature event win value to the threshold value and, if the feature event win value is less than or equal to the threshold value, providing a triggerable second feature event, whereby the second feature event has a prize award potential that is greater than a prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

21. A computing apparatus having a central processing unit, associated memory and storage devices, and input and output devices, the apparatus being configured to perform a method including the steps of:

using the computing apparatus to define a threshold value;

using the computing apparatus to conduct a first feature event, or part thereof, so as to determine a feature event win value; and using the computing apparatus to compare the feature event win value to the threshold value and, if the feature event win value is less than or equal to the threshold value, providing a triggerable second feature event, whereby the second feature event has a prize award potential that is greater than a prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

22. Gaming apparatus including:

a component for defining a threshold value;

a component for conducting at least part of a first feature event so as to determine a feature event win value, said first feature event having a prize award potential; and a component for comparing the feature event win value to the threshold value and, if the feature event win value is less than or equal to the threshold value, providing a triggerable second feature event, whereby the second feature event has a prize award potential that is greater than the prize award potential of the first feature event wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

23. Gaming apparatus including:

a component for defining a threshold value;

a component for conducting at least part of a first feature event so as to determine a feature event win value; and a component for comparing the feature event win value to the threshold value and, if the feature event win value is less than or equal to the threshold value, providing a second feature event that is guaranteed to trigger when a set amount of gameplay is reached without the second feature event having been triggered within the set amount of gameplay;

wherein the set amount of gameplay is calculated in accordance with a calculation scheme that provides an inverse relationship between the set amount of gameplay and the feature event win value.

24. A gaming system including:

a component for defining a threshold value;

a component for conducting at least part of a first feature event so as to determine a feature event win value, said first feature event having a prize award potential; and a component for comparing the feature event win value to the threshold value and, if the feature event win value is less than or equal to the threshold value, providing a triggerable second feature event, whereby the second feature event has a prize award potential that is greater than a prize award potential of the first feature event;

wherein the first feature event includes the provision of a plurality of feature games and wherein the second feature event includes the provision of a plurality of feature games;

wherein the number of feature games provided by the second feature event is calculated in accordance with a calculation scheme that provides an inverse relationship between the number of feature games provided by the second feature event and the feature event win value.

25. A gaming system including:

a component for defining a threshold value;

a component for conducting at least part of a first feature event so as to determine a feature event win value; and a component for comparing the feature event win value to the threshold value and, if the feature event win value is less than or equal to the threshold value, providing a second feature event that is guaranteed to trigger when a set amount of gameplay is reached without the second feature event having been triggered within the set amount of gameplay;

wherein the set amount of gameplay is calculated in accordance with a calculation scheme that provides an inverse relationship between the set amount of gameplay and the feature event win value.

26. The system of claim 24 further including a central control for running a gaming algorithm, and a plurality of remote clients in communication with the central control over a communications network, the remote clients including screens for the display of information to players.

27. A gaming method for use with a gaming apparatus configured to provide a first feature event having a prize award potential, the method including the steps of:

using the gaming apparatus to define a threshold value;

using the gaming apparatus to conduct the first feature event, or part thereof, so as to determine a feature event win value; and using the gaming apparatus to compare the feature event win value to the threshold value and, if the feature event win value is less than or equal to the threshold value, providing a triggerable second feature event, whereby the second feature event has a prize award potential that is greater than the prize award potential of the first feature event;

wherein a multiplier is applicable to at least some prizes awardable in the second feature event;

wherein a value of the multiplier is calculated in accordance with a calculation scheme that provides an inverse relationship between the value of the multiplier and the feature event win value.

28. Computer executable code for instructing a computer to perform a method including the steps of:

using the computer to define a threshold value;

using the computer to conduct a first feature event, or part thereof, so as to determine a feature event win value; and using the computer to compare the feature event win value to the threshold value and, if the feature event win value is less than or equal to the threshold value, providing a triggerable second feature event, whereby the second feature event has a prize award potential that is greater than a prize award potential of the first feature event;

wherein a multiplier is applicable to at least some prizes awardable in the second feature event;

wherein a value of the multiplier is calculated in accordance with a calculation scheme that provides an inverse relationship between the value of the multiplier and the feature event win value.

29. Computer executable code for instructing a computer to perform a method including the steps of:

using the computer to define a threshold value;

using the computer to conduct a first feature event, or part thereof, so as to determine a feature event win value; and using the computer to compare the feature event win value to the threshold value and, if the feature event win value is less than or equal to the threshold value, providing a second feature event that is guaranteed to trigger when a set amount of gameplay is reached without the second feature event having been triggered within the set amount of gameplay;

wherein the set amount of gameplay is calculated in accordance with a calculation scheme that provides an inverse relationship between the set amount of gameplay and the feature event win value.

30. Gaming apparatus including:

a component for defining a threshold value;

a component for conducting a first feature event, or part thereof, so as to determine a feature event win value; and a component for comparing the feature event win value to the threshold value and, if the feature event win value is less than or equal to the threshold value, providing a triggerable second feature event, whereby the second feature event has a prize award potential that is greater than a prize award potential of the first feature event;

wherein a multiplier is applicable to at least some prizes awardable in the second feature event;

wherein a value of the multiplier is calculated in accordance with a calculation scheme that provides an inverse relationship between the value of the multiplier and the feature event win value.

31. A computing apparatus having a central processing unit, associated memory and storage devices, and input and output devices, the apparatus being configured to perform a method including the steps of:

using the computing apparatus to define a threshold value;

using the computing apparatus to conduct a first feature event, or part thereof, so as to determine a feature event win value; and using the computing apparatus to compare the feature event win value to the threshold value and, if the feature event win value is less than or equal to the threshold value, providing a second feature event that is guaranteed to trigger when a set amount of gameplay is reached without the second feature event having been triggered within the set amount of gameplay;

wherein the set amount of gameplay is calculated in accordance with a calculation scheme that provides an inverse relationship between the set amount of gameplay and the feature event win value.

32. A gaming system, comprising:

a component for defining a threshold value;

a component for conducting a first feature event, or part thereof, so as to determine a feature event win value; and a component for comparing the feature event win value to the threshold value and, if the feature event win value is less than or equal to the threshold value, providing a triggerable second feature event, whereby the second feature event has a prize award potential that is greater than a prize award potential of the first feature event;

wherein a multiplier is applicable to at least some prizes awardable in the second feature event;

wherein a value of the multiplier is calculated in accordance with a calculation scheme that provides an inverse relationship between the value of the multiplier and the feature event win value.

33. A computing apparatus having a central processing unit, associated memory and storage devices, and input and output devices, the apparatus being configured to perform a method including the steps of:

using the computing apparatus to define a threshold value;

using the computing apparatus to conduct a first feature event, or part thereof, so as to determine a feature event win value; and using the computing apparatus to compare the feature event win value to the threshold value and, if the feature event win value is less than or equal to the threshold value, providing a triggerable second feature event, whereby the second feature event has a prize award potential that is greater than a prize award potential of the first feature event;

wherein a multiplier is applicable to at least some prizes awardable in the second feature event;

wherein a value of the multiplier is calculated in accordance with a calculation scheme that provides an inverse relationship between the value of the multiplier and the feature event win value.

* * * * *